United States Patent [19]

Frankish

[11] Patent Number: 4,487,160

[45] Date of Patent: Dec. 11, 1984

[54] CONSTANT LEVEL SLURRY TANK

[75] Inventor: Norman W. Frankish, Guiseley, England

[73] Assignee: AEPLC, England

[21] Appl. No.: 560,947

[22] Filed: Dec. 13, 1983

[30] Foreign Application Priority Data

Dec. 14, 1982 [GB] United Kingdom ..... 8235559

[51] Int. Cl.[3] ..... B05C 3/10

[52] U.S. Cl. ..... 118/421; 118/429

[58] Field of Search ..... 118/429, 421, 28, 29

[56] References Cited

U.S. PATENT DOCUMENTS

| | | | |
|---|---|---|---|
| 1,988,955 | 1/1935 | Nehmert | 118/429 X |
| 2,908,249 | 10/1959 | Rokosz et al. | 118/429 X |
| 3,752,383 | 8/1973 | Allen et al. | 118/429 X |

*Primary Examiner*—John P. McIntosh

*Attorney, Agent, or Firm*—Price, Heneveld, Huizenga & Cooper

[57] ABSTRACT

A constant level slurry tank system suitable for use in coating investment casting wax patterns with a ceramic shell by repeated dipping in the slurry. The system comprises a rotating drum, a slurry reservoir and a fixed trough surrounding the drum. The drum has four openings at the desired slurry level, which open into the trough, and two paddles 19 which sweep the trough. A pump constantly pumps slurry from the reservoir into the drum. When the slurry reaches the desired level, excess slurry overflows into the trough via the openings and is swept by the paddles to a trough outlet which leads back to the reservoir.

10 Claims, 1 Drawing Figure

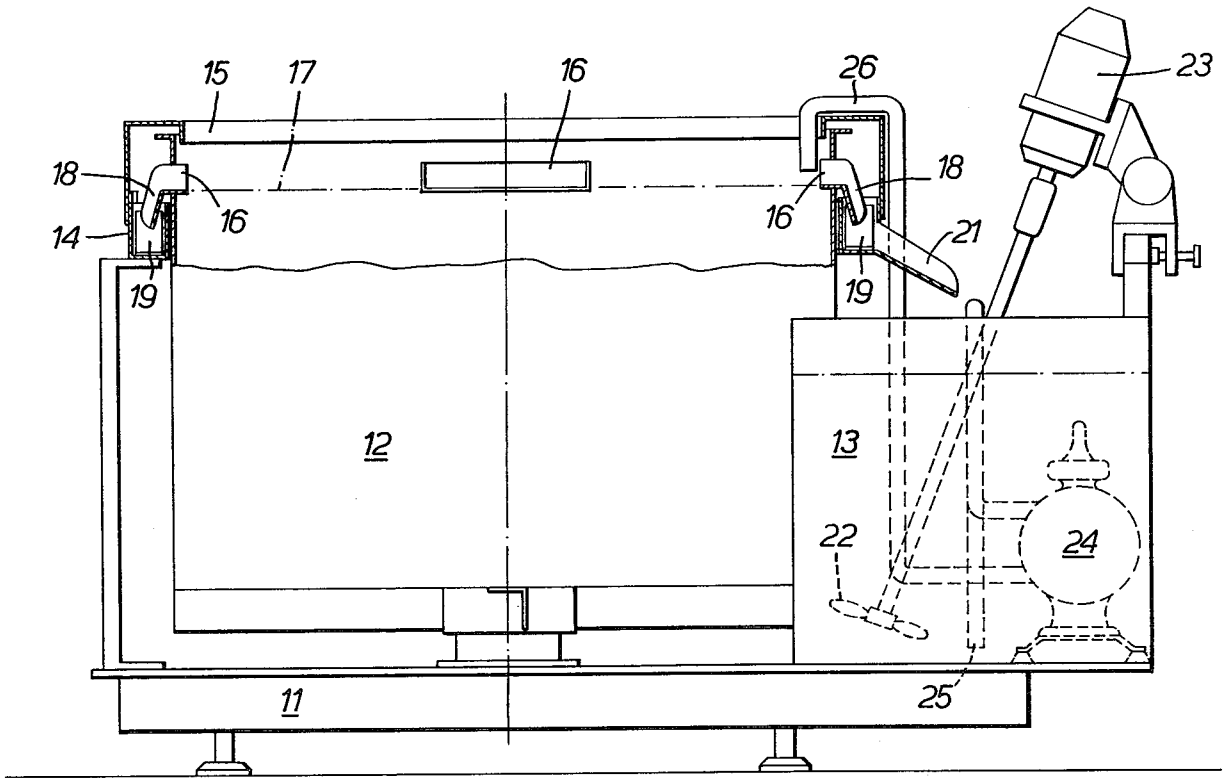
23
24
25
18
21
26
19
13
22
16
16
12
17
11
15
16
19
18
14

CONSTANT LEVEL SLURRY TANK

BACKGROUND OF THE INVENTION

The present invention relates to a constant level slurry tank system in particular for use in coating wax patterns for use in investment casting with a ceramic shell by repeated dipping in the slurry.

The manufacture of high-precision engineering components, such as turbine blades and vanes, by investment casting generally includes the step of forming a ceramic shell on a wax pattern of the final component. This is usually achieved by dipping the pattern into a slurry of the ceramic material, drying the coating and then repeating this procedure until the desired thickness of ceramic coating has been built up. Increasingly, this step is being carried out by automatic machinery or robots.

In many instances, it is important that the patterns are dipped to the correct depth. This is particularly so in the case of turbine blades, the wax patterns of which are generally first joined together into a "tree" to enable a number of blades to be formed in one casting operation. If the tree is not dipped in far enough, the upper parts of the patterns will receive no coating. If the tree is dipped in too far, the conical "pour hole" for the molten alloy will loose its clean complete upper edge.

When the dipping is carried out under manual control, the correct dipping extent can be achieved by the operative, regardless of the depth of the slurry, by experience. However, when the dipping is carried out by robots it is necessary either to vary the dipping distance to take into account changes in slurry level or to operate a constant dipping distance and maintain a constant slurry level. Clearly, it is preferable to avoid using a varying dipping distance due to the complicated control system that this would entail. At the same time however, it would be preferable to avoid the use of a complicated slurry level sensing arrangement and associated slurry feed system. This could of course be achieved by means of a float-operated level control but would suffer the disadvantage that its operation would be intermittent. As a result, the level would constantly fluctuate and there would be a risk of the delivery device blocking up when not in operation.

SUMMARY OF THE INVENTION

It is therefore an object of the present invention to provide a constant level slurry tank system which is simple and economical and yet provides an accurate, continuous constant level.

According to the present invention, there is provided a constant level slurry tank system comprising a rotatable drum, a slurry reservoir, a pump arranged to pump slurry from the reservoir to the drum, and an overflow trough surrounding the drum; the drum having at least one opening at the desired slurry level and means to direct slurry overflowing through each opening into the trough, and the trough having an outlet arranged to drain into the reservoir.

Preferably, the system includes at least one paddle or scraper arranged to sweep the trough. Each paddle is preferably attached to the drum in order to rotate with it, thus sweeping the trough.

The slurry in the reservoir is preferably kept in constant motion by means of an impeller. Any suitable pump may be employed through a peristaltic or double diaphragm pump would be preferred.

The invention also extends to the use of such a system in conjection with robots dipping wax patterns through a constant distance to achieve a coating of the slurry material.

BRIEF DESCRIPTION OF THE DRAWINGS

The single FIGURE is an elevation, partially cut away of a tank system in accordance with the invention, suitable for the dipping of turbine blade wax pattern trees by robots.

DESCRIPTION OF THE PREFERRED EMBODIMENT

The system comprises a fixed base 11 on which a cylindrical drum 12 is rotatably mounted, and a slurry reservoir 13. The drum 12 has a capacity of about 200 gallons (900 liters) and is continuously rotated by a motor (not shown) at about 16 rpm, 24 hours a day. A circular trough 14, which is fixed relative to the base 11, surrounds the drum 12 and is covered by a cover 15. The trough has an outlet 21 to the reservoir 13.

The drum 12 has four equispaced openings 16 at the desired slurry level 17. The openings 16 each have a delivery chute 18 which lets into the trough 14. A paddle 19 is attached to each of two opposite chutes 18. The paddles 19 are located in the trough 14 and have nylon edges. As will be appreciated, as the drum 12 rotates, the paddles 19 sweep the trough.

The slurry in the reservoir 13 is constantly agitated by means of an impeller 22 driven by a motor 23.

In use, a double diaphragm pump 24 located adjacent the reservoir 13 constantly pumps slurry from the reservoir by means of an inlet pipe 25, into the drum 12 via an outlet pipe 26. When the slurry in the drum 12 has reached the desired level 17 it overflows into the trough 14 through the openings 16. The drum 12 constantly rotates so that the paddles 19 sweep the overflowing slurry to the trough outlet 21 and so back to the reservoir 13. Any slurry particles tending to adhere to the trough 14 are scraped away by the paddles 19.

Thus, the constant slurry level 17 can be maintained without any fluctuation, and without the risk of the system becoming clogged with slurry material. Furthermore, the level 17 can be maintained regardless of the size and number of patterns being dipped, and so the system is particularly well-adapted for use with robots operating with a constant dipping distance.

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A constant level slurry tank system comprising a rotatable drum, a slurry reservoir, a pump arranged to pump slurry from said reservoir to said drum, and an overflow trough surrounding said drum; said drum having at least one opening at a desired slurry level and means to direct said slurry overflowing through said at least one opening into said trough, said trough having an outlet arranged to drain into said reservoir.

2. A tank system as claimed in claim 1 including at least one paddle or scraper arranged to sweep said trough.

3. A tank system as claimed in claim 2 wherein said at least one paddle is attached to said drum in order to rotate with said drum thus sweeping said trough.

4. A tank system as claimed in claim 3 including four equispaced openings with two diametrically opposed paddles.

5. A tank system as claimed in claim 1 further including an impeller arranged to agitate said slurry in said reservoir.

6. A tank system as claimed in claim 1 in combination with means for dipping an article into said slurry thereby to coat said article with said slurry.

7. A tank system as claimed in claim 2 wherein means are provided for dipping an article into said slurry thereby to coat said article with said slurry.

8. A tank system as claimed in claim 3 wherein means are provided for dipping an article into said slurry thereby to coat said article with said slurry.

9. A tank system as claimed in claim 4 wherein means are provided for dipping an article into said slurry thereby to coat said article with said slurry.

10. A tank system as claimed in claim 5 wherein means are provided for dipping an article into said slurry thereby to coat said article with said slurry.

* * * * *